US005823421A

United States Patent [19]

Shilcock

[11] Patent Number: 5,823,421

[45] Date of Patent: Oct. 20, 1998

[54] CARDBOARD OR LIKE ARTICLES

[75] Inventor: John Shilcock, Thatcham, United Kingdom

[73] Assignee: Field Group PLC, Bucks, England

[21] Appl. No.: 773,081

[22] Filed: Dec. 26, 1996

[51] Int. Cl.[6] ..... B65D 51/00

[52] U.S. Cl. ..... 229/101; 229/23 BT; 229/195; 229/197

[58] Field of Search ..... 229/23 BT, 101, 229/123, 125.19, 195, 197, 903, 906

[56] References Cited

U.S. PATENT DOCUMENTS

| | | | |
|---|---|---|---|
| 780,445 | 1/1905 | Ramsay | 229/123 |
| 1,930,896 | 10/1933 | Hause et al. | 229/101 |
| 2,147,563 | 2/1939 | Turner | 229/125.19 |
| 2,228,377 | 1/1941 | Wendt, Jr. | 229/101 |
| 2,488,705 | 11/1949 | Buttery et al. | 229/125.19 |
| 3,059,829 | 10/1962 | Thompson | 229/123 |
| 4,079,853 | 3/1978 | Casutt | 229/101 |
| 4,757,940 | 7/1988 | Quick et al. | 229/903 |
| 4,871,111 | 10/1989 | Mode . | |
| 5,230,914 | 7/1993 | Akervik . | |

FOREIGN PATENT DOCUMENTS

| | | | |
|---|---|---|---|
| 0 656 301 A1 | 6/1995 | European Pat. Off. . | |
| 4027363 | 3/1992 | Germany | 229/123 |
| WO 91/06196 | 5/1991 | WIPO . | |

*Primary Examiner*—Gary E. Elkins
*Attorney, Agent, or Firm*—Alix, Yale & Ristas, LLP

[57] ABSTRACT

A lid for a tray, the lid being comprised of a light weight foldable material such as cardboard, is produced from a one-piece blank. The blank has a main body panel and eight side wall panels hingedly extending therefrom. Four of the side wall panels have protrusions for engaging slots in adjacent side wall panels when the lid is erected.

17 Claims, 2 Drawing Sheets

CARDBOARD OR LIKE ARTICLES

BACKGROUND OF THE INVENTION

FIELD OF THE INVENTION

This invention relates to articles made of cardboard or similar lightweight foldable sheet material, of a type intended to be engaged with another part, for example to form a closure therefor.

SUMMARY OF THE INVENTION

According to the invention there is provided an article made of cardboard or similar lightweight foldable sheet material, comprising a body panel structure with side wall panels hingedly connected thereto to form a perimetric side wall structure, and connecting means on at least some of said side wall panels arranged to cooperate with other adjoining such panels to hold the side wall structure together, wherein said connecting means is arranged to hold said side wall structure together in at least two conditions at different angles to said body panel structure.

With such an arrangement, engagement of the article with another part may be facilitated, in that the article may be initially engaged with the other part with its side wall structure in one condition relative to its body panel structure, for example one which enables it to be freely engaged and disengaged, and the side wall structure then adjusted to another condition, for example one in which it becomes held on the other part.

Preferably the said connecting means comprises flaps hingedly connected to said side wall panels and arranged to be engaged with other adjoining side wall panels in different predetermined relative positions in which said wall panels are at mutually different angles to each other and, consequently, to said base structure.

Preferably connecting parts of said connecting flaps comprise hook-like protrusions thereon engageable in cuts or slots in said other wall panels in interlocking fashion, each said flap having at least two such protrusions selectively engageable in the same cut or slot in its associated other wall panel to bring about said different relative positions of the wall panels.

The manner in which the side walls are angled relative to the body in the respective conditions thereof may vary widely, depending upon the context in which the invention is to be applied. For example, a first such condition could be one in which the side walls are inclined outwardly, i.e. splayed, relative to the body, to facilitate engagement of the article with another part, and a second such condition could then be one in which the side walls have been moved inwardly to be perpendicular to the body, to make close fit with the other part. In a presently preferred form of the invention the two conditions are one in which the side walls are substantially perpendicular to the body panel structure and one in which the side walls are inclined inwardly relative thereto, the article then being particularly suitable for secure engagement with another part which has outwardly inclined side walls. A typical example of this latter application of the invention is when the article is a lid and the other part is a tray having outwardly inclined side walls, for example for containing food to be heated in a microwave oven. Obviously very many different variations of the said conditions are possible, and embodiments of the invention may be envisaged in which there are more than two of such, e.g. a first one with outwardly inclined walls, a second one with the walls perpendicular to the body, and a third with the walls inwardly inclined.

BRIEF DESCRIPTION OF THE DRAWINGS

An embodiment of the invention will now be described by way of example and with reference to the accompanying drawings, in which.

DESCRIPTION OF THE DISCLOSED EMBODIMENT

Figure 1:
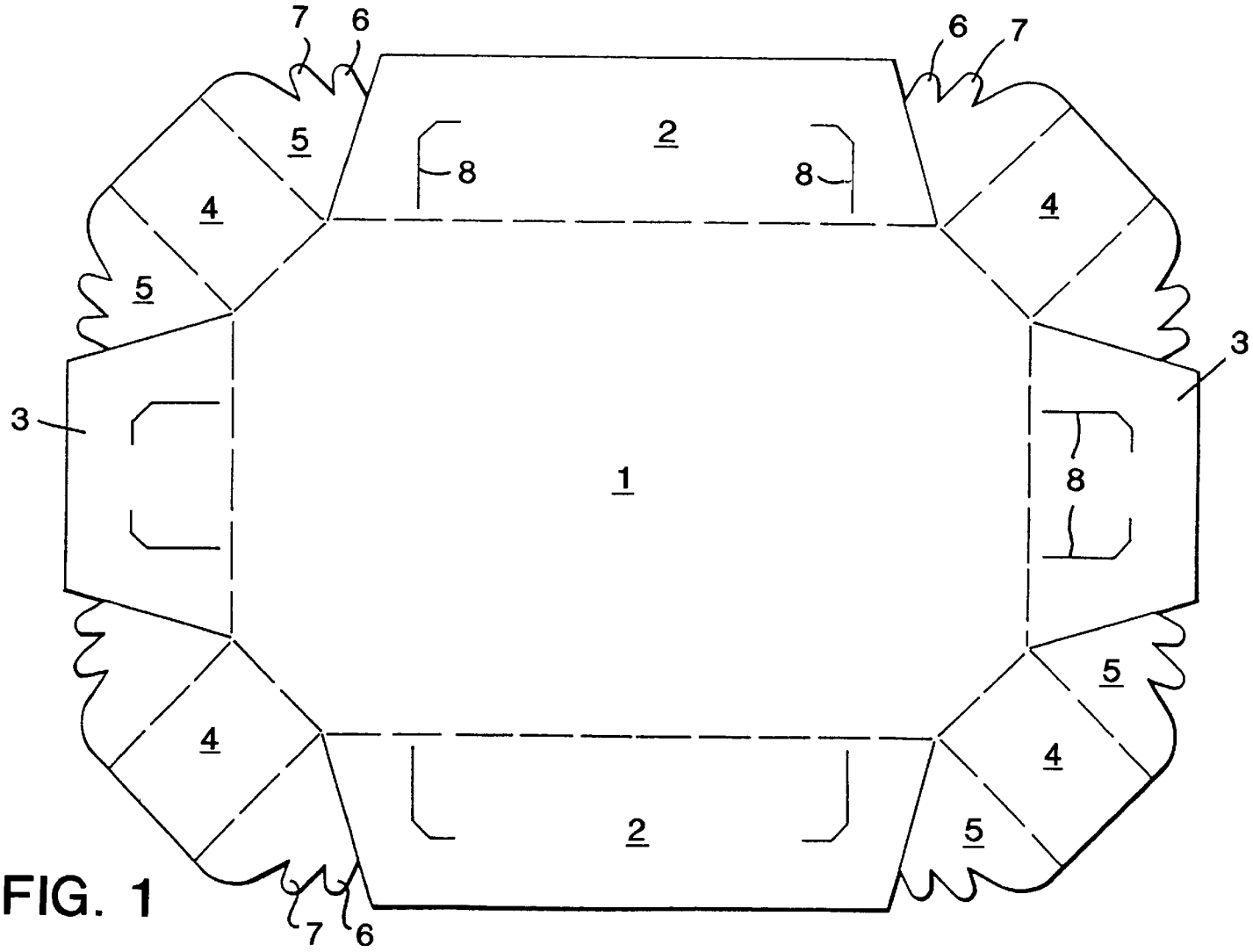
FIG. 1 is a plan view of a cardboard blank for making an article in accordance with the invention, in the form of a lid for a microwave tray.

Referring first to FIG. 1, a one-piece cardboard blank for making a lid for a microwave tray comprises an eight-sided main body panel 1, two side wall panels 2, two end wall panels 3, and four corner wall panels 4. All eight (8) of panels 2, 3 and 4 are hingedly connected to body panel 1. The panels 2, 3 and 4 will hereinafter sometimes be referred to collectively as side wall panels. Each of the corner walls 4 has two connecting flaps 5 hingedly connected to its respective sides. Each such connecting flap is formed with two adjacent connecting parts in the form of first and second hook-like protrusions 6 and 7, and each of the side wall panels 2 and end wall panels 3 is formed near to its respective ends with two shaped cuts 8 for receiving the hooks 6 and 7 in the made up lid, which is indicated generally at 9 in FIGS. 2 to 4.

Figure 2:
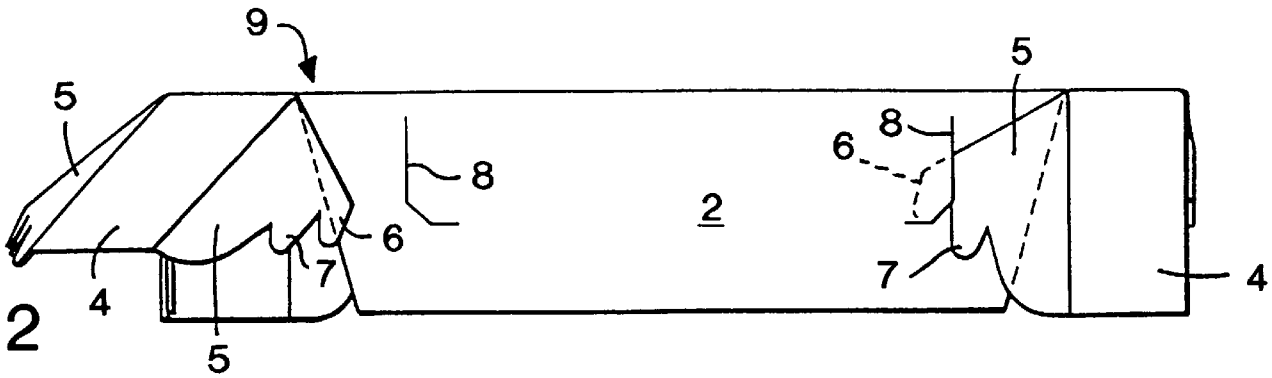
FIG. 2 is a side view of the partially erected lid, before being applied to a tray.
Figure 3:
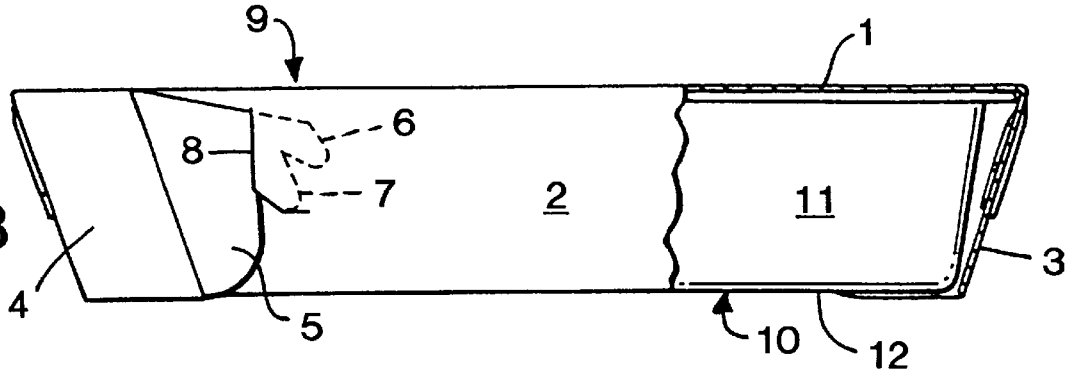
FIG. 3 is a side view, partially in section, showing the lid engaged on the tray.
Figure 4:
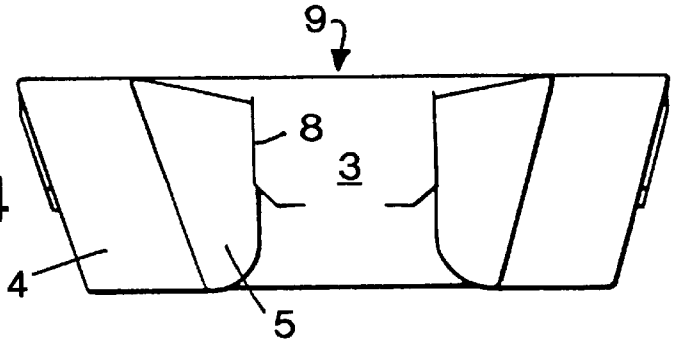
FIG. 4 is an end view of the finished assembly.

Referring now to FIGS. 2 to 4, there is shown an aluminium foil tray 10 for containing food to be microwaved. The tray is of oblong shape with rounded corners and a continuous side wall 11 which is inclined outwardly relative to its base 12 (FIG. 3).

Before applying the lid 9 to the tray 10, the lid is erected to a first condition in which all of its side walls 2, 3 and 4 are perpendicular to its body 1. This is done by folding all of the side walls 2 and end walls 3 down at right angles, then folding down the corner walls 4 with the connecting flaps 5 outside of the adjoining side and end walls, and then inserting the first connecting hooks 6 of the connecting flaps in the cuts 8 in the side and end wall panels, thereby to hold all of the walls in their first condition perpendicular to the body panel. The left hand end of FIG. 2 shows the lid in a condition in which the hooks 6 have not yet been inserted in the cuts, whilst the right hand end shows the lid fully assembled in its first condition.

The lid thus assembled is now dropped over the tray 10, which has already been filled with its intended contents. This is a simple and foolproof operation as the open bottom of the lid in its first (FIG. 2) condition is substantially larger all round than the open top of the tray. All of the second connecting hooks 7 of the lid are now pushed through the cuts 8, as shown at the left hand end of FIG. 3, which has the effect of drawing all of the side walls 2, 3 and 3 inwardly into a second condition of the lid in which the side walls are inwardly inclined at an acute angle relative to the body 1, as shown in FIGS. 3 and 4. The lid is thereby secured on the tray.

In a modification, the side walls 2, 3 and 4 of the lid are deeper than the side walls of the tray 10, so as to support the tray in an elevated position with its base spaced from an underneath surface. This may enable the tray and lid combination to be heated in a microwave oven without having to be placed on a non-metallic plate.

I claim:

1. An article formed from light weight, foldable sheet material, said article comprising a tray having a base and side walls, said article further comprising a lid sized and shaped to cooperate with said tray, said lid including a main body panel, a plurality of lid side wall panels hingedly connected to said body panel to form a parametric side wall structure, and connecting means on at least some of said lid side wall panels, said connecting means cooperating with other adjoining lid side wall panels to define the shape of said lid, said connecting means being arranged to support said lid side wall panels in at least two different angular orientations with respect to said body panel, said lid side wall panels being deeper than said side walls of said tray whereby said lid may support said tray with its base spaced from another surface which is contacted by said lid side walls.

2. An article as claimed in claim 1, wherein said connecting means comprises flaps hingedly connected to said some side wall panels and arranged to be engaged with other adjoining side wall panels in different predetermined relative positions in which said side wall panels are at mutually different angles to each other, the angle between said side wall panels and said base varying with said relative positions of said side wall panels.

3. An article as claimed in claim 2 wherein said flaps comprise protrusions shaped to engage slots in said other adjoining wall panels in interlocking fashion, each of said flaps having at least two of said protrusions selectively engageable in the same slot in a said adjoining side wall panel to establish said different relative positions of said side wall panels.

4. An article as claimed in claim 1 wherein said body panel defines a plane and wherein said two orientations of said side wall panels comprise a first condition in which said side wall panels are oriented substantially perpendicular to said body panel defined plane and a second condition in which said side wall panels are inclined inwardly relative to one another and intersect said body panel defined plane at an acute angle.

5. An article as claimed in claim 1, wherein said tray is suitable for contain food during microwave heating.

6. An article as claimed in claim 5, wherein said two orientations of said side wall panels comprise a first condition in which said side wall panels are oriented substantially perpendicular to said body panel and a second condition in which said side wall panels are inclined inwardly toward one another relative to said perpendicular orientation.

7. An article as claimed in claim 6, wherein said body panel, side wall panels and connecting means comprise a one-piece blank.

8. An article as claimed in claim 1, wherein said body panel, side wall panels and connecting means comprise a one-piece blank.

9. An article as claimed in claim 8, wherein said connecting means comprise flaps hingedly connected to said some side wall panels and arranged to be engaged with other adjoining side wall panels in different predetermined relative positions in which said side wall panels are at mutually different angles to each other, the angle between said side wall panels and said base varying with said relative positions of said side wall panels.

10. An article as claimed in claim 9, wherein said flaps comprise protrusions shaped to engage slots in said other adjoining wall panels in interlocking fashion, each of said flaps having at least two of said protrusions selectively engageable in the same slot in a said adjoining side wall panel to establish said different relative positions of said side wall panels.

11. An article as claimed in claim 10, wherein said body panel defines a plane and wherein said two orientations of said side wall panels comprise a first condition in which said side wall panels are oriented substantially perpendicular to said body panel defined plane and a second condition in which said side wall panels are inclined inwardly relative to one another and intersect said body panel defined plane at an acute angle.

12. An article as claimed in claim 8 wherein said body panel, side wall panels and connecting means comprise a one-piece blank.

13. An article fabricated from light weight, foldable sheet material, said article comprising a body panel, a plurality of side wall panels hingedly connected to said body panel to form a parametric side wall structure, and connecting means on at least some of said side wall panels, said connecting means cooperating with other adjoining side wall panels to define the shape of said article, said connecting means comprising flaps hingedly connected to said some side wall panels and arranged to engage said other adjoining side wall panels in different predetermined relative positions with respect to said body panel, said side wall panels being at mutually different angles to one another when in said different predetermined relative positions, the angle between said side wall panels and said body panel varying with said predetermined relative positions, said adjoining side wall panels having slots therein and said flaps including protrusions shaped to engage said slots in interlocking fashion, each of said flaps having at least two of said protrusions which are selectively engageable in the same slot in a said adjoining wall panel, said different predetermined relative positions comprising at least a first condition in which said side wall panels are oriented substantially perpendicular to said body panel and a second condition in which said side wall panels are inclined inwardly relative to one another with respect to said perpendicular orientation.

14. An article as claimed in claim 13, wherein said body panel, said side wall panels and said connecting means cooperate to define a lid for a tray.

15. An article as claimed in claim 14, further comprising a tray, said tray having a base and side walls, said lid being sized and shaped to cooperate with said tray.

16. An article as claimed in claim 14, wherein said tray is suitable for containing food during microwave heating.

17. An article as claimed in claim 14, wherein said body panel, side wall panels and connecting means comprise a one-piece blank.

* * * * *